US008545646B1

(12) United States Patent
Sanford et al.

(10) Patent No.: US 8,545,646 B1
(45) Date of Patent: Oct. 1, 2013

(54) HIGH-DENSITY ROCKET PROPELLANT

(75) Inventors: Matthew J. Sanford, Bel Alton, MD (US); Randolph T. Johnson, Waldorf, MD (US); Paul G. Wallman, Indian Head, MD (US); Diana O. Bragunier, Indian Head, MD (US); Stephen N. Stiles, Indian Head, MD (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 53 days.

(21) Appl. No.: 12/587,319

(22) Filed: Sep. 24, 2009

Related U.S. Application Data

(63) Continuation-in-part of application No. 11/151,169, filed on Jun. 10, 2005, now Pat. No. 7,624,668.

(51) Int. Cl.
*D03D 43/00* (2006.01)

(52) U.S. Cl.
USPC ..... 149/42; 149/37; 149/75; 149/77; 149/78; 149/79; 149/108.2; 149/109.2; 149/109.4; 149/109.6

(58) Field of Classification Search
USPC ..... 149/37, 42, 75, 77, 78, 79, 108.2, 149/109.2, 109.4, 109.6
See application file for complete search history.

(56) References Cited

U.S. PATENT DOCUMENTS

| | | | | |
|---|---|---|---|---|
| 3,528,864 | A * | 9/1970 | Weinland | 149/92 |
| 3,529,551 | A * | 9/1970 | Barbero et al. | 102/287 |
| 3,933,543 | A * | 1/1976 | Madden | 149/21 |
| 4,798,636 | A * | 1/1989 | Strecker | 149/19.9 |
| 5,910,638 | A * | 6/1999 | Spencer et al. | 149/18 |
| 6,558,488 | B2 * | 5/2003 | Wanninger et al. | 149/19.1 |
| 7,384,060 | B2 * | 6/2008 | Bisognin et al. | 280/728.3 |
| 7,387,060 | B1 | 6/2008 | Sanford | |

* cited by examiner

*Primary Examiner* — James McDonough
(74) *Attorney, Agent, or Firm* — Fredric J. Zimmerman

(57) ABSTRACT

The present disclosure relates to a high-density rocket propellant and associated recoilless launching systems and methods with tungsten powder added providing substantial mass to the propellant for additional impulse, absorption of sound, optimization of back blast and carry weight, and the like. In an exemplary embodiment, the high-density rocket propellant includes tungsten mass percentages of between about 70%-about 80%, equivalent to about 17%-about 26% by volume.

17 Claims, 5 Drawing Sheets

HIGH-DENSITY ROCKET PROPELLANT

CROSS-REFERENCE TO RELATED APPLICATION(S)

This application is a continuation-in-part of U.S. patent application Ser. No. 11/151,169 filed Jun. 10, 2005 now U.S. Pat. No. 7,624,668, and entitled "RECOILLESS LAUNCHING," the contents of which are incorporated in full by reference herein.

STATEMENT OF GOVERNMENT INTEREST

The present invention described herein may be manufactured and used by or for the Government of the United States of America for government purposes without the payment of any royalties thereon or therefor.

FIELD OF THE INVENTION

The present invention relates generally to high-density rocket propellant. More particular, the present invention relates to a high-density rocket propellant with tungsten powder added providing substantial mass to the propellant for additional impulse, absorption of sound, optimization of back blast and carry weight, and the like. In an exemplary embodiment the high-density rocket propellant includes tungsten mass percentages of between about 70%-about 80%, equivalent to 17%-26% by volume.

BACKGROUND OF THE INVENTION

Shoulder Launched rockets were first demonstrated at the end of World War I and have been widely used since World War II. Their development was driven by the need for light infantry to engage armored threats and by the development of shape charge-based anti-tank warheads. Although grenade-launching devices working off the barrels of rifles were also used, they were relatively lightweight and low velocity to limit the amount of recoil or kickback to the gunner. To get around this limitation, larger recoilless concepts were developed. Two well-known propulsion methods used in these devices are the rocket and the Davis Gun. Simple rocket versions include a warhead mounted on the nose of a rocket motor. They were shot out of a hollow aiming tube that was open on both ends. The appearance resembled a musical instrument called a bazooka. Some launch tubes had a reduced area at the rear to form a flow restriction, and a nozzle behind that to counter recoil caused by the restriction. The widely used Carl Gustaf gun is an example of this variation.

Rockets used by the Marine Corps include the Shoulder-launched Multipurpose Assault Weapon (SMAW) and M72 Light Anti-Tank Weapon (LAW). These rockets burn out prior to leaving the launch tube. The rocket nozzles have a relatively large throat area and they use a plastic blowout plug to aid ignition. The propellant sticks have a high surface area, producing high pressure and short burn times. These characteristics result in considerable back blast, and form a lethal zone behind the gunner. The resulting high sound levels and overpressure precludes them from being fired from enclosures (FFE) and confined spaces (CS) under all but the most desperate situations. Another common propulsion method is a two-stage rocket, used by many popular low-budge foreign rocket-propelled grenades (RPG's). After an initial ejection, the second rocket continues to burn outside of the launch tube. They are less accurate because small kickoff errors, upon exiting the launch tube, accumulate during the second burning stage, while the launch tube no longer guides the motor's thrust. They are also slower at close range because top speed is not achieved until both burn stages are complete.

In an urban battlefield environment, it is desirable to fire from confined spaces in order to limit exposure to hostile fire. The propulsion method most commonly used for this purpose is the Davis Gun. The original Davis Gun originated around World War I, patented by Commander Cleland Davis (U.S. Pat. Nos. 1,108,715 through 1,108,717 issued to Davis on Aug. 25, 1914). He attached two gun barrels together at their breeches and launched two bullets in opposite directions with no recoil forces to the launch barrel. This concept applied to a shoulder-launched device includes a propelling charge between the warhead and a dispersible countermass, which exits to the rear. The Davis Gun uses much less propellant than a rocket for the same warhead weight and exit velocity. However, the carry weight of a round is nearly doubled because the countermass typically weighs as much as the projectile.

The Davis-Gun has the disadvantage of requiring significantly more weight and length than a smokeless propellant-based rocket motor. Added weight and length is simply not an option due to the increasingly heavy load-out weight carried by today's troops. The smokeless rocket motor has the disadvantage of emitting a tremendous amount of sound and back blast, and performing very badly in Insensitive Munitions (IM) tests. All of the smokeless propellant based rocket motors (such as SMAW and M72 LAW) fail IM bullet impact, fragment impact, and slow cook-off testing with explosive reactions. These motors have historically been granted IM waivers to enable their in-service use in the short-term; however, they will ultimately require an IM compliant charge in order meet Navy requirements. The smokeless propellants used in shoulder-launched ordnance are typically double base formulations of nitrocellulose and nitroglycerin. SMAW and M72 LAW use a well-known MIL-SPEC formulation called M7, which is widely used in various weapons systems.

A similar motor is used in some two-stage missiles such as TOW. The TOW launch motor also uses M7 propellant and has the disadvantage of emitting extremely high acoustic emissions in the free-field launch environment. A common disadvantage of many smokeless propellant applications is that there is a limited volume available for propulsion. When higher launch velocities are desired or additional payload weight is needed, there is no way to get additional impulse without incurring unacceptable tradeoffs. For example, if the proportion of nitroglycerin is increased, than the IM properties get worse. If additional high-energy materials are added to the propellant (such as aluminum powder) to increase total impulse per unit volume, the resulting clouds of oxide smoke after the launch give away the position of the gunner. The requirement that the propellant be relatively smokeless and fast burning compositions severely limits the options available.

BRIEF SUMMARY OF THE INVENTION

In an exemplary embodiment of the present invention, a rocket propellant includes propellant material and tungsten powder mixed with the propellant material at a time of manufacture, wherein the tungsten powder includes a mass percentage relative to the propellant material of about 70%-80%, equivalent to 17%-26% by volume of the propellant material. The propellant material mixed with the tungsten powder is pressed out in a geometry such that the tungsten powder is thoroughly and uniformly dispersed with the propellant material. The propellant material includes nitrocellulose, nitroglycerin, potassium perchlorate, ethyl centralite, and carbon black. The tungsten powder includes a size range of about 5-about 150 microns or about 5-about 44 microns in diameter. The mass percentage of the tungsten powder and the tungsten particle size range are selected to optimize total impulse, sound reduction, and Insensitive Munitions performance. The rocket propellant is utilized in one of a Shoulder-launched Multipurpose Assault Weapon (SMAW) system and a Light Anti-Tank Weapon (M72 LAW) system. The rocket propellant is formed with a grain geometry including thick walled long burning solid or hollow cylinders.

In another exemplary embodiment of the present invention, a system for recoilless launching includes a portion to be launched, where the portion has a predetermined weight; a non-gaseous reaction mass portion a weight in a range of about one-fourth to three-fourths of the predetermined weight; a pressure vessel moveably receiving the reaction mass; and a pressurized propellant gas generation mechanism in the pressure vessel so that the portion to be launched and the reaction mass are motivated in opposite directions by the gas. The portion to be launched is moveably received in the pressure vessel so that the portion to be launched and the reaction mass move oppositely in the pressure vessel on launching. The pressure vessel is included in the portion to be launched. The system further includes a receiving mechanism for the portion to be launched that is configured to guide the portion during launching. The configuration of the pressure vessel and the pressurized propellant gas generation mechanism are selected so that, upon launching, the momentum magnitude of the reaction mass is about equal to the momentum magnitude of the portion to be launched. The pressurized propellant gas generation mechanism includes a quantity of propellant for progressive reaction to generate the pressurized propellant gas, and the reaction mass is particulate material associated with the quantity of propellant so that generation of the pressurized gas releases the particulate material at a rate corresponding to the rate of generation of the pressurized gas. The particulate material includes tungsten powder mixed with the propellant material at a time of manufacture, where the tungsten powder includes a mass percentage relative to a propellant material of about 70%-about 80%, equivalent to about 17%-about 26% by volume of the propellant material.

In yet another exemplary embodiment of the present invention, a method for formulating a high-density rocket propellant includes determining a balance between a carry weight of a device and back blast of the device when fired; determining a mass percentage of tungsten relative to a propellant material and a particle size of the tungsten, where the mass percentage and the particle size are responsive to the balance; and mixing an amount of tungsten based on the mass percentage and the particle size with the propellant material thereby thoroughly and uniformly dispersing the tungsten within the propellant material. The method further includes utilizing the mixed tungsten and the propellant material in the device thereby providing a low-blast propulsion system. The mass percentage includes a range of about 70%-about 80%, equivalent to about 17%-about 26% by volume of the propellant material. The propellant material includes nitrocellulose, nitroglycerin, potassium perchlorate, ethyl centralite, and carbon black. The particle size includes a range of about 5-about 150 microns in diameter.

BRIEF DESCRIPTION OF THE DRAWINGS

The present invention is illustrated and described herein with reference to the various drawings, in which like reference numbers denote like method steps and/or system components, respectively, and in which.

DETAILED DESCRIPTION OF EXEMPLARY EMBODIMENTS OF THE INVENTION

Figure 1:
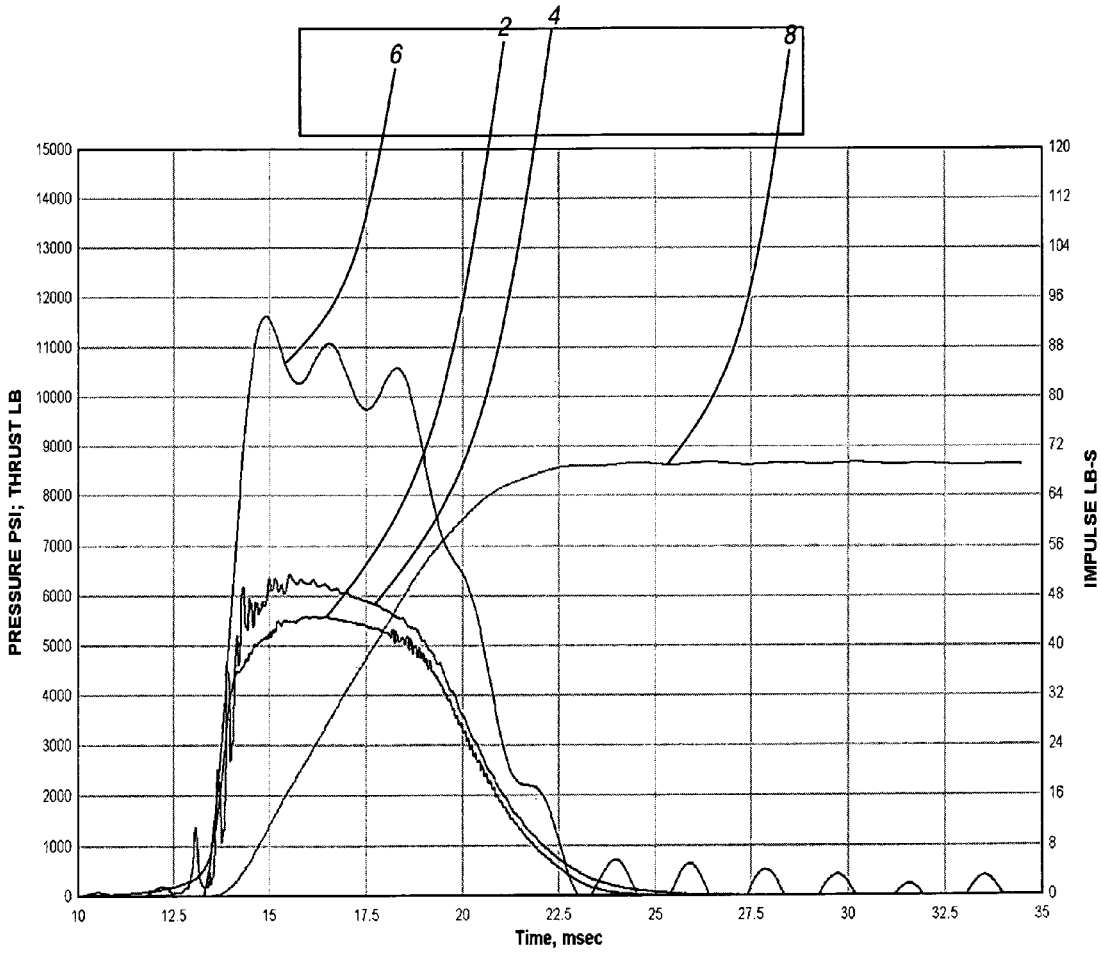
FIG. 1 is a graph illustrating testing results utilizing M7 propellant alone.

In various exemplary embodiments, the present invention relates to a high-density rocket propellant developed primarily to reduce back blast and acoustic emissions. The present invention adds tungsten powder to a propellant to form the high-density rocket propellant. The tungsten powder adds substantial mass (tungsten is much heavier than the propellant itself), and thereby provides additional impulse. It also absorbs sound, damps acoustic emissions, and allows for more optimal balance between carry weight and back blast. The mixtures disclosed include tungsten mass percentages of between about 70%-about 80%, equivalent to about 17%-about 26% by volume. The new propellant formulation is a homogeneous mixture of tungsten powder and energetic smokeless propellant M7. The tungsten powder is mixed in with the M7 propellant components at the time of manufacture. The result is that when the final composition is pressed out to the desired inner and outer diameter (or other) geometry, the tungsten powder is thoroughly and uniformly dispersed within the other components. When burned in a rocket motor, the tungsten for the most part remains inert and solid (unmelted and unburned), is released and fluidized during the energetic component burn, and accelerated by the nozzle of the rocket motor. The additional mass exiting the motor results in additional impulse, absorbs sound energy, damps acoustic emissions within the motor, launch tube, and exit cone. The tungsten powder also serves to convert some of the residual energy from hot expanding gasses to kinetic energy in the form of fast moving, hot, dense powder, which rapidly disperses and slows upon exiting the motor.

The high-density rocket propellant also improves total impulse per unit volume and Insensitive Munitions (IM) properties such as cookoff and bullet/fragment impact. The high-density rocket propellant may be utilized to provide a low-blast propulsion system for firing shoulder-launched munitions, e.g. from within enclosures or confined spaces or the like. This configuration enables them to be fired from buildings and bunkers, meeting the demands of increasingly urban warfare, and taking advantage of newer thermobaric warheads. Static rocket motor tests on the new propellant formulations indicate that they provide significant reductions in sound levels over M7 alone. Static tests on M72 motors developed a significant increase in total impulse per unit volume over M7 alone, on the order of 25%. This formulation may be of use on other applications with volume-limited rocket motors (such as the TOW launch motor) in which the propellant weight is a small percentage of the system weight. M7 (as specified in MIL-P-14737 (AR) 2 Feb. 1989) is a mixture of nitrocellulose (~55%), nitroglycerin (~36%), potassium perchlorate (~7.8%), ethyl centralite (~0.9%), and carbon black (~1.2%).

An advantage of adding tungsten powder to the energetic material is that it allows one to choose a more optimal balance between carry weight and back blast, essentially a new option that lies between the extremes of conventional Davis Guns and Rocket motors. The mass percentage of tungsten and the tungsten particle size range may be varied in order to optimize total impulse, sound reduction, or IM performance. To date, not every concentration and particle size range has been tested due to practical limitations. There is likely more than one single tungsten concentration and particle size range that is good for all three, but some have been identified that have significant improvements in all three areas.

The new propulsion concept evolved from three basic observations on existing systems. The first observation is that a rocket motor provides the lowest carry weight but has an undesirable back blast. The second observation is that a Davis Gun provides an acceptable level of back blast with an unacceptable weight penalty. The third observation is that rocket motors use significantly more propellant than Davis Gun propulsion systems. One solution could be to develop some combination of the two in order to meet the unique requirements of low blast and low carry weight. Rockets and guns have very different mechanical configurations and combining them could look more like a gun or more like a rocket. The countermass weight has to be significantly less than the projectile's flight weight, and exit more rapidly. The gun version is more difficult from the perspective of weight, length, complexity, countermass dispersion, and cost, so the rocket version is described herein with respect to the present invention.

In the present invention, a countermass is added to a rocket by adding an inert, fine material (such as tungsten powder) to the propellant as an integral part of the formulation. As the propellant burned and transitioned from solid to gas, the inert component remains a fine solid powder. It enters the turbulent gas flow and becomes fluidized. The powder is carried along by the gas flow and accelerated in the nozzle, similar to a sandblasting device. The ideal material is very dense with a high melting point and a small particle size. It takes up minimal volume in the propellant, settles more quickly after ejection, and provides less of a visual launch signature. Of note, a desirable feature for such a device is to minimize the lethal zone behind the launcher. In particular, some launch requirements state that no lethal fragments are permitted to pass through a double sheet rock wall, ½" Celotex, and a ⅜" plywood sheet. Other launch requirements specify a cinder block wall. A fine dense countermass is most appropriate. Its high drag coefficient helps it accelerate in the nozzle, disperse, and slow down quickly upon exiting the launch tube. A good analogy is throwing a handful of sand versus a rock. Ideally, the particles slow down rapidly and embed themselves within the wall, or pass through and exit with less than lethal velocity.

In an exemplary embodiment, tungsten powder in the size range of about 5-about 44 microns may be used as the inert powdered countermass material. Tungsten is extremely dense (approximately 13 times the density of M7) and has a very high melting point, approximately 6,000° F. It is not pyrophoric, toxic, or expensive, and it is commercially available. Other size ranges can also be used such as an average 5-micron particle size, about 44-about 75 micron, and about 75-about 150 micron diameter. In an exemplary embodiment, the initial about 5-about 44 micron particle size was originally chosen in consideration of the following conflicting factors, and was ultimately found to be the best performer. These conflicting factors include: smaller particles favor acceleration in a gas flow and require shorter nozzles whereas larger particles are less likely to ignite outside the launch tub and might form a large and undesirable visual signature. Smaller particles disperse more rapidly, slow more quickly outside the launch tube, and be more likely to damp sound emissions whereas larger particles are more likely to settle quickly in a room, bunker, or alley. Particle size affects mixing and processing properties. Particle size affects impact, friction, and electrostatic sensitivity. Finally, particle size affects burn rate and ignitability.

In experimentation, component weights were examined for the Marine Corps Shoulder-launched Multipurpose Assault Weapon (SMAW) system (a re-usable launcher) using the standard High Explosive, Dual Purpose (HEDP) warhead. Differences between the rocket system and two prototype Davis Gun propulsion systems were noted. The Davis Gun encased rounds were about twice the overall weight as the rocket rounds due to the countermass required. The Davis-Gun warhead flight weight does not have to include the spent rocket motor case, but the encased round carry weight includes the expensive and complex high-strength composite gun barrel for launching the countermass. A reduced flight weight actually has some disadvantages. It slows down more quickly due to air drag, and it has less penetrating power and less stability during penetration, which are important factors for bunker or wall penetrating warheads. The analysis below assumes that an 8.5 lb flight mass is desired.

For a SMAW HEDP round of 8.5 lbs flight weight, the propellant required was about 0.9 lb. Both Davis Gun designs for that device were about 18 lbs pre-flight weight. Both used about 1/10 lb of propellant. It was counterintuitive that much less propellant was needed to propel more weight, so this possibility was investigated resulting in some surprising results. The physics behind this outcome eventually made sense when taken from a pre/post flight control volume approach. A detailed thermodynamic analysis of the combustion and flow through the rocket and modifications to the rocket motor model to account for large mass fractions of inert solids in the flow is discussed further herein. The following is the basic rationale behind the new propulsion concept. The mass, impulse and velocity values are approximate but close enough to demonstrate the concepts. The basic force, mass and acceleration relationship equation is:

$$F=(1/g_c)m\times a$$

where F=force (lbf), m=mass (lbm), a=acceleration (ft/s$^2$), $g_c$=gravitational constant=32.2 using lbm; 1 using slug; 1 using kg. Since a=dv/dt, inserting dv/dt in for a makes the basic equation become:

$$F=(1/g_c)\times m\times(dv/dt)$$

Rearranging results in Fdt=mdv/$g_c$. This equation is the same as stating impulse=momentum change. If a propelling charge were placed in a heavy-walled tube between any two masses and set off, both masses would receive an equal push and an equal total impulse, even if their mass were not the same.

$$I_1=I_2=m_1\times v_1=m_2\times v_2$$

where I=impulse (lb-s), $m_1$=mass$_1$ (lbm), $m_2$=mass$_2$ (lbm), $v_1$=velocity of mass$_1$ (ft/s), $v_2$=velocity of mass$_2$ (ft/s).

In the case of the SMAW Davis Gun, the forward moving warhead and rearward moving countermass weigh the same.

$$m_1=m_2=8.5 \text{ (lbm) and } v_1=v_2=725 \text{ (ft/s)}$$

Then $I_1=I_2=6{,}162.5$ (lbm ft/s)(1/32.2 for using lbm), and converting the units, $I_1=I_2=6{,}162.5$ (lbm ft/s)(1/32.2)(lbf/lbm ft/s$^2$)=191.4 (lbf s). Thus the SMAW Davis Gun impulse imparted to the warhead and countermass is 191.4 (lbf s). If one were to mount a SMAW rocket motor on a thrust stand, fire it, and take thrust data over the duration of the burn, and then integrate that curve, they would find that the SMAW Rocket total impulse equals the integrated thrust time curve, which equals 191.4 (lbf s). The integrated thrust time curve represents the total impulse, which has the same units as the change in momentum of the item being acted upon.

If a given impulse were to act on a different mass, it ends up with a different velocity. If a Davis Gun were made with a countermass weighing a different amount than the warhead, its velocity is a function of the impulse delivered and the countermass weight. Using the force-mass-acceleration equation from above $$Fdt=mdv/g_c$$

Rearranging it to get velocity as a function of total impulse and mass (where $I_t$=Fdt), dv=F×dt×$g_c$/m would become the following equation dv=$I_t$×$g_c$/m thus Velocity of the warhead or countermass as a function of impulse and mass is dv=$I_t$×$g_c$/m (ft/s). Something very interesting happens when one looks at the kinetic energy obtained by the warhead and countermass when they do not weigh the same. After launch of a SMAW HEDP warhead, the kinetic energy it acquires is given by:

$$KE=\tfrac{1}{2}\times m/g_c\times v^2 \text{ Where KE=energy (ft lbf)}$$

Plugging in the following values: $g_c$=32.2; m=8.51 lbm; v=725 ft/s. The kinetic energy of a SMAW warhead leaving the launcher is 69,457 (lbm ft$^2$/s$^2$) and converting units, KE=69,457 (lbm ft$^2$/s$^2$) (lbf/lbm ft/s$^2$)=69,457 (ft lbf) thus the SMAW Warhead's total kinetic energy equals 69,457 (ft lbf).

If that same impulse of 191.4 (lbf s) were acquired by a 0.9 (lbm) countermass (the SMAW propellant burning and exiting as gas), it has to exit much more quickly, with an average velocity of:

$$dv=I_t\times g_c/m$$

$$dv=191.4\times 32.2/0.9 \text{ (lbf s)/(lbm)}\times\text{(lbm ft/s}^2\text{)/(lbf)}$$

$$dv=6{,}848 \text{ ft/s}$$

The kinetic energy of those exhaust gasses would then be:

$$KE=\tfrac{1}{2}\times m/g_c\times v^2$$

$$KE=\tfrac{1}{2}\times(0.9/32.2)\times(6{,}848)^2 \text{ (lbm)}\times\text{(ft}^2\text{/s}^2\text{)}\times\text{(lbf)/(lbm ft/s}^2\text{)}$$

$$KE=655{,}366 \text{ (ft lbf)}$$

The SMAW exhaust's total kinetic energy equals 655,366 (ft lbf).

The SMAW rocket may be viewed as a Davis Gun with a very light countermass. The countermass of the rocket (the mass of the rocket exhaust gasses) requires roughly ten times the amount of energy needed to accelerate the warhead. This is why the rocket version of SMAW needs a greater quantity of propellant than the Davis Gun version with a heavy countermass weight. Note, the velocity equation can also be plugged into the kinetic energy equation to get the kinetic energy of a warhead or countermass as a function of the applied impulse and the mass:

$$KE=\tfrac{1}{2}\times m/g_c\times(g_c\times I_t/m)^2 \text{ which simplifies to } KE=\tfrac{1}{2}\times I_t^2\times(g_c/m)$$

K. E. of the warhead or countermass as a function of impulse and mass is KE=½×$I_t^2$×($g_c$/m) (ft lbf).

The following tables below summarize the ejected weight and the quantity of kinetic energy (ft-lbf) attained by the warhead and rearward-moving exhaust products for three different SMAW propulsion systems, the rocket, the Davis Gun, and the tungsten laden M7 low-blast rocket motor.

| PROPULSION SYSTEM TYPE | WEIGHT OF WARHEAD | WEIGHT OF EXHAUST | WEIGHT TOTAL |
|---|---|---|---|
| ROCKET MOTOR (100% M7) | 8.50 | .90 | 9.40 |
| DAVIS GUN | 8.50 | 8.50 | 17.00 |
| ROCKET (30% M7-70% TUNGSTEN) | 8.50 | 2.03 | 10.53 |
| ROCKET (20% M7-80% TUNGSTEN) | 8.50 | 2.71 | 11.21 |

| PROPULSION SYSTEM TYPE | K.E. OF WARHEAD | K.E. OF EXHAUST | K.E. TOTAL |
|---|---|---|---|
| ROCKET MOTOR (100% M7) | 69,457 | 655,366 | 724,823 |
| DAVIS GUN | 69,457 | 69,457 | 138,914 |
| ROCKET (30% M7-70% TUNGSTEN) | 69,457 | 290,545 | 360,002 |
| ROCKET (20% M7-80% TUNGSTEN) | 69,457 | 217,602 | 287,060 |

The mass used for the tungsten laden M7 propellant for a 70% tungsten mass percentage formulation is shown, as well as that used for an 80% tungsten mass percentage below it. The standard SMAW motor uses approximately 15 cu-in of M7 propellant. A reduced total propellant volume (about 80%) of the M7/tungsten formulation is needed due to the increased impulse per unit volume characteristics observed in the full-scale static M72 testing of both the 70% and 80% tungsten formulations. For that reason, a propellant volume of 12 cu-in is used for both. For the 70% tungsten formulation, this equates to a total mass of 2.03 lb, made up of 0.61 lb M7 and 1.42 lb tungsten. Assuming a desired total impulse of 191.4 lb-s and a 2.03 lb exhaust mass, the exhaust products would have to exit with an overall average velocity of approximately 3,036 ft/s. For the 80% tungsten formulation, this equates to a total mass of 2.71 lb, made up of 0.54 lb M7 and 2.17 lb tungsten. Assuming a desired total impulse of 191.4 lb-s and a 2.71 lb exhaust mass, the exhaust products would have to exit with an overall average velocity of approximately 2,274 ft/s.

In other words, after firing, for either the warhead or countermass, (Impulse=mass×velocity). However, both would only get an equal percentage of the available energy if their masses were the same weight. This relationship reflects the typical Davis Gun design; it uses a dispersible countermass of approximately equal weight to the projectile. The projectile and countermass would then have the same mass and exit velocity and therefore the same kinetic energy (K.E.) of motion on exit. If one of the two masses weighed much less than the other, the lighter of the two receives more of the available energy. This result is counterintuitive in that both masses are exposed to and receive the same impulse, yet they acquire different amounts of kinetic energy. The unusual result occurs because both have equal area, are exposed to the same pressure, and are therefore exposed to the same force.

Given the same force, the lighter mass accelerates more quickly. Since the lighter mass has a higher acceleration, it exits and vents the launch tube sooner and at a higher velocity. The lighter mass gets the lion's share of the available energy because for K.E., the velocity component is squared, so it dominates.

Yet another way to view it is that the basic equation of acceleration (force=mass×acceleration) rearranged to (acceleration=force/mass) shows that for a given force, acceleration is higher for a lighter object than a heavier one. The lighter mass travels farther, exits, and vents the launch tube before the heavier mass moved very far. If (work done=force× distance) and both saw the same force, the lighter mass covers a longer distance and has more work done on it.

A real-world analogy that can be drawn from this is that three basic propulsion configurations can be viewed as similar devices with different mass ratios between the warhead flight mass and countermass. The large Naval Gun, the Davis Gun, and the Rocket Motor, are related as follows. In a Naval Gun, the flight mass is low (the projectile), and the countermass is very heavy (the gun barrel, mount, and to some extent the ship itself). In a Davis Gun, the flight mass and the countermass are equal in weight. In a Rocket Motor, the warhead flight mass is heavy compared to the countermass (the exhaust gas), which is low in weight. The nozzle is a clever way to maximize the gas exit velocity for momentum exchange. This configuration is the least efficient way (energy wise) to launch the projectile, and the only reason it works at all is because the entire countermass is composed of energetics (stored energy).

When the flight mass is less than the countermass, as in the Naval Gun, the lowest quantity of propellant (per projectile) is used. When the flight mass is much heavier than the countermass, as in the case of the rocket motor, the largest quantity of propellant is used. The Davis Gun is in the middle, requiring less propellant than a rocket but more propellant than a conventional Gun. The application ultimately determines the best ratio of flight weight to countermass weight to use. If extra weight is not critical, the large Naval Gun would be the most "efficient" device, using the least propellant per projectile. If weight is very critical, as in the case of a man portable device used on the open battlefield, then the rocket motor is the most "efficient" device, requiring the least overall carry weight per projectile, even though it uses the most propellant per projectile. For the shoulder launched confined space application, the best combination appears to be a mass ratio, which is something between a rocket and a conventional Davis Gun. The countermass weight should be more than a rocket's propellant weight but less than the warhead weight.

In the previous paragraph, the word "efficient" was used to gage the amount of propellant in the first sentence, and to gage the carry weight of a man portable device in the second. In the rocket motor world, efficiency is often referred to as the total impulse per unit mass of propellant with the term specific impulse. For the new device envisioned here that incorporates an inert countermass within the propellant as 70-80% of the total propellant mass, the question arises whether to count the countermass weight when calculating specific impulse. Not counting it makes the propellant appear to be incredibly efficient, and counting its mass makes it appear to be terribly inefficient. A more applicable metric would be total impulse per unit volume when comparing the high-density propellant mixes to standard propellants and to one another, especially for propulsion systems that are volume limited. The system requirements for weight, back blast, volume, etc. must be considered to determine which propulsion method is best.

Another consideration of heavily tungsten laden M7 formulations is the absorption of heat energy by the inert countermass material. It was generally assumed that due to the small particle size and relatively large surface area to volume ratio of the particles, they rise up to the flame temperature of the propellant, thus absorbing some heat energy that might otherwise go to propulsion. The more tungsten in the mix, the more heat it will absorb. Some initial calculations indicate that since no phase changed is involved, the lost energy is not really significant until the countermass weight is over about 80% of the total propellant weight. It is really not known how much if any of that lost heat energy is returned to the gasses in the nozzle during expansion, and if any added impulse comes of it. The form of energy entering the room is the main concern, hot expanding gasses create more of a sound and blast problem than hot but rapidly cooling particles. The increased impulse per unit volume performance of the tungsten mixes is a strong indication that energy lost to heating the particles is not a serious problem.

Formulation and testing was performed of two generic smokeless compositions of particulate nitrocellulose/nitroglycerin (PNC/NG), one energetic only and the other with 50% tungsten powder by weight. These compositions were cast in pans and machined into rectangular slabs (2.5"×1.5"× 0.75"), then fired in a sub scale rocket motor test setup. Other formulations and testing used M7, although a substitution of 12.6 nitrated NC was made versus 13.2 NC in the earlier mixes. The test setup included a generic pressure vessel with a load cell, a pressure transducer, and a nozzle. This "slab motor" was an existing setup designed to test pan samples of production lots of propellant during production runs. It was ignited by 5 grams of $BKNO_3$. The nozzles were available in a variety of throat diameters, and testing included repeating the test with consecutive smaller diameter nozzles until the desired peak internal pressure was obtained. The data was analyzed for performance characteristics, and compared to a ballistic model. Some of the objections included: ensuring that the propellant would ignite despite the 50% mass ratio of inert to energetic; ensuring that the burn rate would not fall off as a result of the added inert material; ensuring that the tungsten powder would exit the nozzle without igniting, clogging, or causing extreme erosion of the nozzle; ensuring that adding the tungsten powder to the propellant did not increase hazards such as impact, friction, and electrostatic sensitivity; ensuring that the dispersed hot tungsten powder would not ignite upon exit of the nozzle, creating a significant increase in flash; and ensuring that sufficient total impulse would be developed despite the reduction in energetic propellant mass, and loss of heat to the inert powder Tests on small hand-mix samples indicated that impact, friction, ESD, and compatibility would not be significant issues, and the new formulation was made. Positive results for all of the above objectives were obtained. Initially the most significant concern was that the propellant would develop insufficient total impulse. No loss in total impulse/volume was observed. Further details on each of the items listed above are provided as follows.

With respect to ensuring the propellant would ignite despite the 50% mass ratio of inert to energetic, a number of rectangular samples of propellant were made both with and without tungsten, and tested in the mini ballistic slab motor. The energetic component of the propellant was a generic PNC/NG smokeless composition. The inert component was a tungsten powder about 5-about 44 microns in diameter. The samples containing tungsten powder were found to ignite properly, in a similar manner to the non-tungsten containing samples. It should be noted that since the tungsten powder has close to 13 times the density of smokeless propellant, the samples with 50% tungsten by mass had only 7% tungsten by volume.

With respect to ensuring that the burn rate would not fall off as a result of the added inert material, there did not appear to be a large difference in burn rate on the limited number of samples tested. The samples were not configured specifically for burn rate measurement, so the rates had to be inferred by comparison to one another and to a ballistic model. Air entrapment in the mix is suspected to be partially responsible for some of the variations. With respect to ensuring that the tungsten powder would in fact exit the nozzle without igniting, clogging, or causing extreme erosion of the nozzle, the test samples containing tungsten did burn completely. The tungsten powder did not appear to ignite either inside the motor or after exiting the nozzle. They did not clog the nozzle, but there was high-speed video evidence of some clumps exiting the nozzle, which appeared to correlate with pressure spikes. Post shot inspection observed that the configuration of two phenolic cylinders used to retain and separate the burn sample from the nozzle contributed to a buildup of tungsten powder on the lee side of the cylinders. This buildup occasionally broke free in clumps. Low-pressure tests (under 1500 psi peak) appeared to leave some deposits in the nozzle throat. Higher-pressure tests did not leave deposits. No nozzle erosion was measured on either soft graphite or stainless steel nozzles used in the testing.

With respect to ensuring that adding the tungsten powder to the propellant did not increase hazards such as impact, friction, and electrostatic sensitivity, hazard characterization tests were run on small samples prior to mixing larger batches used in the slab motor tests. Tests indicated that adding tungsten at a 50% mass ratio did not increase anything significantly, and appeared to decrease some of them. The inert tungsten powder when tested alone gave a false positive for electrostatic sensitivity. The criterion for that test is a visible reaction. This result would be expected from discharging high voltage into metal powder in the presence of oxygen, even a metal that is not particularly pyrophoric like tungsten. With respect to ensuring that sufficient total impulse would be developed despite the reduction in energetic propellant mass, and loss of heat to the inert powder, integrated thrust data from the testing indicated that there did not appear to be a loss in total thrust per unit volume as a result of adding a 50% mass ratio of tungsten into the propellant, and may even have resulted in a slight increase. Low-pressure burns did appear to have a slight loss but this result was interpreted as incomplete and inefficient burning, evidenced by tacky residue on the nozzle and in the motor. High-pressure burns did not deposit tacky propellant residue, and had a slight dusting of light blue powder.

In another exemplary embodiment, a double-base plastisol propellant was developed to provide an energetic binder system that could be processed with a high-solids fill of tungsten powder while varying its particle size. The composition is common among double-base propellants in that it contains the energetic polymer nitrocellulose and the energetic plasticizer nitroglycerin. In considering the desired test specimens required for the mini ballistic slab motor, a composition was developed with the intent that it could be processed using conventional casting techniques. The availability of materials was another consideration. The composition included approximately 57% pelletized nitrocellulose (PNC), 31% nitroglycerin (NG), 10% triacetin (TA), 1% ethyl centralite (EC) and 1% 2-nitrodiphenylamine (2-NDPA). Pelletized nitrocellulose is a spherical particle of about 10-microns in diameter. The material was manufactured on-site by precipitation of a nitromethane/water emulsion. PNC is stored as a heptane-wet suspension and contains the stabilizer ethyl centralite. The PNC is screened and dried in a 140° F. oven to remove foreign material and heptane. The PNC is later resolvated with heptane when mixing with the nitroglycerin solvent. Vacuum is used to remove heptane at the end of mix. The nitroglycerin was prepared by the Biazzi process and formulated with triacetin and the stabilizer 2-NDPA. Standard chemical analysis is employed to verify stabilizer content of the PNC and nitroglycerin for safe storage of these materials.

The wide range of tungsten particle sizes and concentrations yielded a variety of viscosities, ranging from castable to those requiring pressing. The final solvent level also affected the workability of the mixes, ranging from overly fluid, soft & sticky, to dry and crumbling. The primary objective was to get decent samples of various particle sizes and concentrations in as uniform geometry as possible to do an initial screening of the effects of those variables. This objective was accomplished, although it was eventually concluded that the energetic formulation was really not satisfactory for extruding thin walled hollow single perforation propellant sticks as used in SMAW and M72.

A short summary of the modeling effort is provided here. The ballistic model was created using a pre-existing rocket ballistic spreadsheet. Because of the nature of the ballistic cycle for the short burntime rocket, volume filling and emptying phenomena predominate over the steady-state ballistics normally assumed for rocket internal ballistic models. Because of the high pressures of interest in this effort (in excess of 3000 psi), the co-volume equation of state was employed for calculating the pressure in the chamber. The free volume of the chamber was reduced by the particles, which had been released from the block of propellant but not yet ejected from the chamber.

The ejection of the particles from the chamber is achieved by a drag interaction with the gases produced by the propellant. The velocity of the ejection is calculated in a separate Excel spreadsheet and input as a function of gas throat velocity into the ballistic model. The particles are assumed to be ejected at this velocity using the area of the throat and the volume percentage of particles inside the rocket motor. The quantity of particles inside the rocket motor is adjusted for each time step.

A concern in the development of the model was heat exchange between the propellant gases and the particles released. As a first approximation, the particles were assumed to come to thermal equilibrium with the gas during their ejection from the block of propellant. The thermal equilibrium assumption effectively decreases the flame temperature of the propellant-particle composite. Another term was added to the heat loss term that accounts for heating the surface of the rocket motor housing.

The present invention also included an investigation of the following items: expanding the range of different tungsten concentrations to find limits and optimal concentrations; expanding the particle size ranges tested; exploring the effect of various nozzle lengths, inlet and outlet geometries; exploring the effect of different peak pressures; and exploring the effect of different grain geometries and igniter materials. With respect to expanding the range of different tungsten concentrations to find limits and optimal concentrations, propellant samples containing 70% to 85% tungsten by mass were fabricated and tested in two configurations, a solid cylinder 2.12" diameter and 2.5" long; and a similar cylinder with a 1" diameter hole bored completely through the axis. The optimal concentration of tungsten for obtaining total impulse per unit volume appeared to be with 70% mass concentration of tungsten, giving a maximum increase of 30-40% total impulse per unit volume. The 80% tungsten mass concentrations showed an increase in total impulse per unit volume of about 16%. These are likely on the high side for several reasons. One reason is unknown levels of air entrapment in the test samples with and without tungsten, which affect the volume calculation. Samples were weighed prior to testing. Another source of error was the igniter material. The igniter rarely burned completely, an unknown quantity was always ejected out of the motor. Although the igniter mass was relatively small compared to the propellant quantity, many of the shots exhibited a snuff-out phenomena described below. This phenomena resulted in only a percentage of the sample burning. The resulting shot analysis of partial shots allowed an estimate to be made of the material that burned properly and contributed impulse. This estimate made the igniter mass to propellant mass an even bigger unknown. These were the best results; many tests did not function properly for a number of reasons that will be discussed in detail below. The maximum tungsten concentration that was properly burned was 80%.

With respect to expanding the particle size ranges tested, four tungsten particle size ranges were tested; about 5 micron average, about 5-about 44 microns, about 44-about 75 micron, and about 75-about 150 micron in diameter. These were tested in the 70% and 80% tungsten mass concentrations. The trend was more thrust with smaller particles. The two largest particle sizes exhibited some degree of ignition delay when used in 70% and 80% concentrations, even when the igniter material was increased and thermite was added to the ignition mix. At the time of testing it was not known why this occurred. Subsequent investigation indicates that the ignition delay is due to increased thermal conductivity of the bigger particles near the propellant surface. The two smaller particle size ranges did not exhibit significant ignition delay.

With respect to exploring the effect of changing nozzle length and nozzle inlet and outlet geometries, the mini ballistic slab motors use a standard graphite nozzle of approximately 2" in length. They do not use a blowout plug to aid ignition, so throat diameter selection is difficult, critical, and sometimes impossible. Too large and the sample would not ignite, too small and it would over-pressurize and the graphite would fail and blow out. A number of different nozzle designs were experimented with, on the assumption that longer nozzles would hold the particles in the flow longer and accelerate them more. The results indicate that while longer nozzles might increase momentum transfer between the gas and the tungsten particles, very little additional thrust is gained. Most of the thrust appears to be generated at or just beyond the throat section. The internal pressure and throat area are the primary drivers for thrust.

One hypothesis for why total impulse does not drop despite a reduced quantity of energetic is that the addition of tungsten allows use of a larger throat area than could otherwise be used with less energetic. The fine dense tungsten particles cause a flow restriction in the throat that result in more efficient use of the gas pressure. This inertial blockage holds in some of the gasses and allows them to do more work. However, too much flow restriction predictably resulted in too much backpressure. A gentler inlet angle appeared to help open up the allowable range of throat diameters, probably as a result of the solid particles not having to make a sudden direction change. In the real-world application of with a rocket traveling down a launch tube, the launch tube section behind the nozzle exit actually functions as a nozzle extension, at least as far as momentum transfer between the gas and tungsten particles. Just when the momentum transfer between the gas and particles occurs appears to have a significant effect on whether or not it contributes to thrust. Later tests on full-scale motors indicate that the particles pick up considerable velocity prior to reaching the nozzle throat, based on erosion of the nozzle inlet. Those shots appeared to have the best impulse performance.

With respect to exploring the effect of different peak pressures, burn pressure had a significant effect on the burning of the tungsten filled propellants. A peak pressure of at least 1500 psi was needed to get decent thrust values without premature shutdown of the burn. The burn pressure appears to be intimately linked to a significant new problem encountered with the high tungsten content propellants, which will be referred to the "snuff-out" phenomenon. This phenomenon will be discussed in detail below, but can be summarized as a problem in which late in the burn, the pressure suddenly drops. The remaining partially burned sample continues to "fizzle" until all of the energetic is burned off, leaving a remaining smaller, porous, soft tungsten sample. Apparently if the burn duration is long, the tungsten concentration is high, and the pressure is low, the evolved tungsten interferes with heat transfer from the flame front to the propellant surface and it shuts down. The remaining hot propellant cooks off slowly with little or no propulsive effect. In order to use the data from partial tests, the quantity of tungsten remaining was used to estimate the total quantity of propellant burned. Work done later indicates that the snuff-out phenomenon is not a problem with propellant configurations such as SMAW and M72.

With respect to exploring the effect of different grain geometries and igniter materials, high tungsten concentrations of 70% and 80% tungsten by mass appear to favor short, high pressure burns. This results was a new and unexpected result. The grain geometries used initially were thick walled, long burning, solid and hollow cylinders described above. If the peak pressure does not rise above around 2000 psi, then the burn snuffs out after about 25% of the propellant has burned properly. It fizzes off leaving a reduced size sample of porous tungsten powder. Increasing tungsten concentration appears to worsen this problem. Increasing the peak pressure to above 5000 psi delays this until 75% or more of the sample has been consumed. Switching to the hollow cylinder versus the solid cylinder helped reduce the amount of left over sample. Although $BKNO_3$ was primarily used for igniters, a quantity of thermite was added the igniter mix on several occasions as an experiment. No significant improvements were observed. Work in subsequent years was done on other igniter materials, of which black powder with relatively large particle sizes worked best.

Additional efforts were investigated to include: exploring use of M7 as the energetic base vice in the original generic smokeless composition; fabricating propellant in geometry similar to that used by SMAW and LAW; modifying a test motor to more closely simulate conditions in SMAW and LAW; testing propellant at ambient and cold temperature (−40 F); performing preliminary sound output tests; performing analysis tool refinement; performing closed bomb tests; investigating toxicity risks of tungsten; exploring the effect of different peak pressures; and exploring the effect of different igniter materials and blowout plug ejection pressures.

With respect to exploring the use of M7 as the energetic base vice the original generic smokeless composition, a generic smokeless composition was used for the initial investigation into the tungsten laden smokeless concept. Positive test results led to further development of the concept. The original target applications for this technology, SMAW and M72, both use M7 as the propellant in their rocket motors. This composition is somewhat faster burning than the generic smokeless composition. It was thought that using M7 as the base propellant in combination with tungsten powder would be efficient. Since the M7 was already being used in the rocket motors of SMAW and M72, using less of it in combination with something inert would not sound as risky. Given the many potential pitfalls of propellant development and transition from R&D to weapon systems, this seemed like the least risky venture and it appears to be working. There may be significant benefits to using this approach on other propellant systems. The initial concerns with adding the tungsten powder in significant mass percentages to the M7 ingredients were compatibility and sensitivity related issues. No significant issue related to mixing and extruding was found for the M7/tungsten formulations in the 70% and 80% tungsten mixes. In fact, the tungsten mixes proved to be more consistent in the extrusion process than the M7 alone. These difficulties were at least in part related to a substitution made for the Nitrocellulose (NC). There were delays obtaining NC in the proper 13.2% nitration level called out in the M7 specification. The 13.2% NC was substituted with 12.6% NC in order for the project to progress. The 12.6% NC M7 did not behave very well during extrusion. It either came out too soft and sticky or too dry and tended to crack. A number of things were tried to get it to extrude with a decent surface finish and proper geometry, including heating the die, using more and less solvent, different die geometries, etc.

With respect to fabricating propellant in geometry similar to that used by SMAW and LAW, the geometry of propellant used in SMAW and M72 differs significantly from those used in the initial tests of the concept. The initial testing was done first on slabs of propellant, and then on 2.125" diameter cylinders, some with a 1" hole in the center. Conversely, the long hollow single perforation propellant used in the rockets has an outer diameter of 0.236", a wall thickness of approximately 0.040", and) lengths on the order of 6". Lengths of 2.50" were used for the small-scale simulator that was modified to more closely replicate SMAW and M72 conditions. The thin walled propellant burned much better and never resulted in motor shut down, although low-pressure burns consistently produced correspondingly lower total impulse results.

With respect to modifying a test motor to more closely simulate conditions in SMAW and M72, a shorter duration, higher pressure motor was needed to continue the work. Full-scale hardware or simulated hardware could have been used, but it was thought that difficulties in making the propellant to the exacting geometries required might drag on and kill the program. It was also desirable to make a number of different formulations and test them quickly, changing out the stick number and type between shots. Making full-scale rockets for this kind of testing was deemed impractical. The current slab motor with its graphite nozzle and lack of blowout plug was also impractical, due to difficulties in choosing a nozzle small enough to allow proper ignition without blowing up. Peak pressures were limited to around 3500 psi, and a peak pressure of 8,000-10,000 psi was desired. A new test motor was designed and fabricated. It was designed to use approximately ⅕ the propellant of an M72 rocket, and burn at similar pressures. It was designed with a blowout plug and a ½" diameter stainless steel nozzle. Instead of changing throat diameter, the number of propellant sticks was varied to adjust peak internal pressure. The blowout plugs were made of several different materials to vary the ignition pressure. The LDPE plugs were usually used, exiting at approximately 3500 psi. The test motor was designed to use 2.5" long sticks of propellant made in the OD and ID of full-scale rockets. The number of sticks used varied between 10 and 40 to bring the peak pressure to desirable levels. A multi-hole catcher plate was used to hold the sticks in during the burn, so the steps involved with affixing sticks to a pin plate or mounting plate could be avoided for fast turn around. The test motor was very successful. It was shot over 60 times with different formulations, numbers of propellant sticks, igniter materials, etc.

With respect to testing propellant at ambient and cold temperatures (−40° F.), for the first time propellant was cooled to −40° F. The propellant was found to be capable of igniting and burning properly. There was not a significant performance drop at cold temperature if proper operating pressure was attained. These tests were some of the first indications of some of the differences between the M7/tungsten formulations and M7. The small-scale results indicated that the tungsten mixes performed poorly at pressures below 3000 psi and better at higher pressures, compared to M7 alone, in terms of thrust per unit volume. The 70% tungsten mixes provided more total impulse for a given volume than the 80% mixes, which performed similar to M7 alone.

With respect to performing preliminary sound output tests, a number of preliminary sound output tests were done with the small-scale motor. These indicated that during the burn, the tungsten mixtures put out significantly less noise than M7 alone when holding total impulse constant. With respect to performing analysis tool refinement, more work was done to refine the analysis model. It was found that treating the tungsten powder as a very dense gas improved the analytical prediction, bringing it closer to actual test results. The test results continued to show higher total impulse values than the analysis model. Later work showed that the propellant stick length is actually a significant variable. Long stick lengths with little room between them tend to provide a pre-acceleration to the tungsten powder prior to a significant acceleration at the nozzle throat. Either the catcher plate used in the small-scale test motor or the shorter stick length affected the performance of the tungsten mixes to some degree. The 70% tungsten mix consistently showed about a 9% improvement in impulse per unit volume over M7 alone in the small-scale tests, and roughly a 25% improvement on full-scale tests. Stick length appears to affect burn rate due to erosive burning effects also. All of the factors mentioned above are difficult to capture in an analysis model.

Closed bomb tests were done to determine how tungsten in the formulation affects burn rate. A limited number of tests were done with the 70% mixture initially. Oddly enough there did not appear to be a significant effect. The tests went up to a maximum of 10,000 psi, which is on the low side. Test results from the small-scale test motor indicate a slightly lower burn rate for the tungsten mixtures, and test results from the full-scale static test indicates a slightly higher burn rate for the tungsten mixtures. One hypothesis is that the catcher plate and loose sticks in the small scale motor cause a higher tungsten concentration to exist, which affects heat transfer between the flame front and propellant surface. The tungsten exits more cleanly in the full-scale motor, and possibly aids in erosion near the end of the sticks. Erosion on the inlet side of the nozzle was observed in the ambient and hot full-scale test hardware, and never on the small-scale test hardware.

All of the evidence compiled to date indicates that pure tungsten is not a toxicity risk. Pure tungsten is used in the M7/tungsten formulations. The MSDS sheets for powdered tungsten list the only hazard as being a nuisance dust, as with any powdered material. Tungsten is reported to be somewhat soluble, so it is eventually expelled from the body naturally. When tungsten is alloyed with other more toxic heavy metals, such as nickel or cadmium, there is evidence of toxicity risk. The risk involved with any potential toxic hazard is significant so additional studies will be done as time and money permit. Standards governing exposure to airborne tungsten particles exist and they can be monitored during full-scale tests. Tungsten is dense so it does settle quickly. It is likely that the greatest situation of concern will be to training personnel exposed to multiple repeated emissions. As with other propellant emissions, it is expected that acceptable procedures to avoid hazards can be developed.

With respect to exploring the effect of different peak pressures, previous work on the tungsten compositions were hampered by the limited pressure range of the slab motor test vehicle. They use a relatively weak graphite nozzle that fails between 3000 and 4500 psi. The tungsten propellants were found to be difficult to ignite at low pressures, especially when using thick walled cylinders with relatively low surface area. Those limitations, combined with lack of a blowout plug to aid ignition, made it difficult to get data. The new motor described above was designed to overcome these limitations. A significant number shots were done using the ⅕ scale test motor, mostly on 70% tungsten formulations. The most notable difference observed between M7 alone and the tungsten formulations was that the tungsten formulations (in the ⅕ scale motor) exhibited approximately 9% more impulse per unit volume than the M7 alone. Another difference was that when too few sticks of the tungsten formulation were used and the peak pressure did not rise above 3000 psi, the motor developed significantly less total impulse. The energetic component of the propellant will burn off, but much of the tungsten is either left behind or exits at low velocity, without contributing to thrust; This explained some of the widely varied results obtained during earlier slab motor tests. The new motor was comfortable with peak pressures of 8-10 kpsi, right in the range of a tactical M72 rocket motor. The low-pressure burn characteristics might potentially be exploited for improved IM cookoff performance if a melt-away blowout plug can be developed. A number of successful tests were conducted at −40° F. propellant temperature. The tungsten mixes did not appear to lose as much total impulse as the M7 alone, as long as it was ignited properly and achieved a high peak pressure.

With respect to exploring the effect of different igniter materials and blowout plug ejection pressure, a number of different igniter materials were experimented with. Up to this point, 5 grams of $BKNO_3$ was primarily used. Some tests had been done with the addition of 2-3 grams of thermite powder. The supply of easily available $BKNO_3$ was diminishing, and some work was done using fine smokeless propellant, used on some other motor development efforts. The smokeless was thought to put off more pressure, where the $BKNO_3$ was thought to put off more flash and heat. Another reason to get away from $BKNO_3$ was that much of it was ejecting upon plug blowout, and embedding into a sheet rock witness panel behind the motor. The smokeless powder did not appear to improve ignition significantly. Three blowout plug materials were initially made, LDPE, HDPE, and Delrin. They are listed in order of increasing strength, which resulted in different blowout pressures. Some were even trimmed in an attempt to modify blowout pressure even more. It was eventually concluded that even the weakest, LDPE, provided sufficient internal pressure to ignite the tungsten mixes. The quantity of igniter material was also varied during these tests to some degree. At some point, it became obvious that too many variables were being modified with over too few shots, making shot-to-shot comparisons increasingly difficult. An igniter material study was undertaken to determine clearly which igniter material and how much was best for igniting the tungsten mixes. This information will be described in more detail below, but the winner turned out to be FFG black powder Class IV.

Additional efforts were performed to: improve the extruded propellant surface quality and dimensional accuracy; provide an igniter material and quantity study; evaluate propellant for impulse performance in the ⅕ scale motor; evaluate propellant for sound performance in the ⅕ scale motor; design, fabricate, load and static test a full scale M72 simulator; determine the optimal quantity of tungsten in the formulation; determine how to simulate the method of mounting the tactical blowout plug without RTV; and transition the propellant development effort to real-world weapon system applications.

With respect to improving the extruded propellant surface quality and dimensional accuracy, the first efforts to extrude M7 and M7/tungsten formulations had some success. The geometry is somewhat difficult for SMAW and M72 propellant. The relatively small OD of 0.236" and the relatively thin wall single perforation, combined with swelling on die exit and shrinkage upon drying, made it difficult to end up with uniform shaped propellant with the proper dimensions. One of the problems faced was that initially a substitution was made for the NC. 13.2% nitrated NC was on order and unavailable, so 12.6% nitrated NC was used. When the 13.2% material did come in, it was found that it processed differently, reacting in a different manner to the solvents. Another difference between the ATK and Indian Head (IH) process emerged, in that ATK adds pure nitroglycerin directly to the NC. At IH, NG is only available with 40% acetone due to shipping requirements for safe transit. NG is not made at IH at this time. This additional solvent affected the mixing process and final consistency of the formulations.

Initially, there were differences between the equipment used by ATK and IH. These included press sizes, die sizes, and lead-in geometry to the dies. Initially, existing dies and stakes were used at IH, as was a 3" heated press, in order to avoid time and costs making die and stake sets. The testing done on the propellant didn't need to be done on exact tactical geometry. Both M7 and M7/tungsten formulations were made for direct comparisons. An effort was made to improve the extrusion quality and dimensions, as work on either M72 or a SMAW motor was planned. Nothing could be done about the acetone in the NG. A 4" unheated press was used so the same crew could be used to mix and press to save money. A set of dies and stakes were made with a wide variation in sizes. The stakes and dies were made interchangeable. This would allow propellant to be extruded to either the SMAW or M72 geometry (slightly different inner diameters) and to account for shrinkage upon drying. A number of things were learned. First off, the M7/tungsten formulations tended to swell less on die exit, and tended to have better surface quality. However, the M7/tungsten mixes tended to stretch more when hanging downward upon die exit if they were on the soft side. The tungsten containing mixes also tended to shrink less upon drying. The blow-down time after mixing to remove excess solvent was found to be critical. While too dry a mix tended to crack and split upon die exit, mixes on the dryer side were found to stretch less and hold their size better during drying. If the end of the hollow propellant was pinched closed during cutting, the ensuing extrusion would form a vacuum and the sides would collapse and stick together. Extruding onto aluminum cones was found to save time, as a significant quantity of propellant would self-wrap before being taken away for cutting, layout on waxed boards, and drying. While all of those methods helped significantly, it was still found to be very difficult to hold the geometry of the final dried extruded propellant to better than ±0.005" consistently. Changing the blow-down time from 7 minutes to 14 minutes could result in up to a 0.040" difference in the outer diameter. Apparently, there is quite a learning curve involved. Propellant composed of M7 alone and with both 70% and 80% tungsten was successfully made. It was of acceptable quality to allow a large number of full-scale static M72 tests and a number of ⅕-scale static tests.

A short igniter study was done using the M7/70% tungsten formulation in the ⅕ scale motor. The purpose behind this investigation was that the ignition needs of the new propellant were largely unknown. $BKNO_3$ was not used because it was not easily available and because it was observed to be burning only partially prior to motor exit. Other smaller particle size $BKNO_3$ can be obtained with some effort but this was held as a backup plan. There had been occasional tests initially that failed to ignite, and it was not clear whether additional heat, pressure, or igniter quantity would help. Some limited testing was done in adding thermite to the $BKNO_3$ igniter mix with the thought that additional heat would be beneficial, although no significant improvement was observed. It was thought that the presence of tungsten on the surface of the propellant was acting as a heat sink. A study found that FFFG black powder had less of an ignition delay for a given powder quantity than 700× smokeless powder. Later tests on full scale M72 simulation hardware done at hot and cold temperatures experienced some new ignition problems. There were some cold shots that did not ignite, and some hot ones that ignited too well and ramped up too quickly to undesirable pressure levels. Modifying the igniter quantity or modifying the blowout pressure with igniter blowout plug modifications had a tendency to flip-flop the problem. What helped cold hurt hot performance, and vice-versa. Modifying the overall propellant quantity up or down had the same effect. A functional solution was eventually found by using a slower burning black powder, FFG Class IV, which was found to ignite cold full-scale shots more consistently and cause less overpressure on hot shots. The general conclusion is that the ignition needs of the M7/tungsten mixes are very similar to M7 alone, in terms of type and quantity of igniter material. Both SMAW and M72 use black powder in their igniters.

With respect to evaluating propellant for impulse performance in the ⅕ scale motor, a ⅕ scale motor was used to obtain rough order of magnitude performance characteristics of M7, M7/70% tungsten, and M7/80% tungsten samples. In this motor, 2.5" propellant samples are loosely placed, and there is a catcher plate with gas release holes between the propellant and nozzle. The propellant samples had similar but not identical geometry so the total impulse was held constant at approximately 18.6 lb-s. Three shots of each formulation were fired at ambient conditions. Impulse per unit volume (lb-s/cu-in) averaged 14.5 for the M7 alone, 14.04 for the M7/80% tungsten mix, and 15.72 for the M7.70% tungsten mix. The average peak pressure (kpsi) attained was 8.6 for the M7 alone, 4.2 for the M7/80% tungsten mix, and 7.7 for the M7/70% tungsten mix. It was concluded that the loose stick and catcher plate configuration is not very conducive to accelerating and removing fluidized tungsten from the motor, although is works significantly better than the older slab motor configuration. It is thought that increased levels of tungsten may have slowed down the action time of the tungsten containing motors somewhat by interfering with heat transfer between the flame front and propellant surface. This situation is thought to be responsible for the longer burn times and lower peak pressures for the tungsten mixes compared to the M7 alone. The full-scale motor tests done later did not have longer burn times for the tungsten mixes, and had an even greater improvement in total impulse per unit volume of the M7/70% tungsten mix over M7 alone.

During the ⅕-scale impulse performance tests, microphone sound pickups were included a short distance from a simulated launch tube, which was mounted over the end of the static motor nozzle outlet. The tests were conducted in a firing bay with three walls, a ceiling and a floor, and a garage door opening, which the rocket motor exhaust fired out of. There were multiple surfaces for sound reflections. Although this is not a standard room for collecting sound data on confined space or fire from enclosure full scale live shots, it was deemed close enough to get a rough order of magnitude comparison between the M7 only and tungsten containing formulations. In summary, the tungsten mixes were found to significantly reduce the sound emissions from the rocket motor. This is thought to occur because there is less energetic present for a given total impulse, the sound emissions are somewhat damped by the presence of the fine airborne tungsten powder, and some of the propellant energy is converted to accelerating and heating tungsten powder, so the gases are moving more slowly. Sound reductions of approximately 4 dB and 6 dB were observed with the 70% and 80% tungsten mixes respectively on the first positive peak. Significantly less total sound was emitted over the duration of the burn with the tungsten mixes.

Prior to doing a full-scale flight test demonstration, full-scale static tests were conducted. Items like igniter material and quantity, blowout plug design, propellant quantity, propellant geometry, etc. are most effectively tweaked at this stage. The M7/tungsten development effort was initially approached in the conventional manner. Analysis, slab tests, small-scale tests, tactical geometry, and then tactical motors. Unfortunately, its characteristics turned out to be so unusual that every time one stage was perfected, the next stage had an entirely different set of challenges. Although important things were learned at every stage, a good argument could be made that it would have been easier to start with a full-scale motor at the outset. The burn rate is a good example. A long duration, low pressure static burn can cause a high concentration of tungsten powder that can slow the burn or even put it out. A short duration high pressure burn with long thin walled propellant sticks can burn faster than M7 alone, probably due to erosion of the propellant sticks and efficient scavenging and acceleration of the powder.

A heavy walled simulated M72 rocket motor was designed and fabricated. It contained a pressure port near the lead in to the throat, and one at the head end. The head end screwed into existing hardware. A replaceable nozzle screws into the rear. The inlet and outlet cones were part of the nozzle. M72 rockets have a pin plate, to which propellant sticks are affixed. They contain small pins with a plastic sleeve that are bonded to the inside of the propellant sticks, similar to those used in TOW. For most of the static tests, the propellant sticks were mounted with epoxy and #6 screws to the mounting plate, in order to save time and reduce cost. The propellant stick and mounting plate assembly was held in place in the heavy walled tube with an internal C-clip. Over three dozen tests were done with this setup. A mount was fabricated to allow use of tactical aluminum rocket motor cases. Those cases have an external thread on the outside portion of the head end of the rocket motor case. Six tests were done with this setup. One problem noted with the tactical rocket motor cases was erosion on the inlet cone of the nozzle. This was more pronounced on hot shots. Either a thicker section or an insert will likely be needed to preclude the possibility of burn-through.

With respect to the optimal quantity of tungsten in formulations, as the discussion of the igniter material study indicated, igniting these motors over a temperature range from −40° F. to 140° F. is a challenge, either with M7 or M7/tungsten. The higher the percentage of tungsten, the more difficult it gets. This result is intuitive to some degree as the more tungsten present, the less energetic material will be available to ignite. Good results were obtained with 70% tungsten mixes at all temperatures, and 80% mixes were experimented with successfully at ambient temperatures. 80-85% tungsten is probably very close to the practical limit for any motor, and weight goes up dramatically at higher percentages. The 70% mixes had better impulse performance, and the 80% mixes put off less sound. The optimal percentage of tungsten for maximizing impulse per unit volume is not known. The original objective of this work was to reduce back-blast and sound output, without significantly increasing propellant volume. It was initially thought that the best solution would be with the most tungsten, as long as the carry weight was not increased too much. For a weapon such as SMAW, the limit for carry weight would be around 83% tungsten, adding around 3 lbs to the rocket motor. When significant improvements in impulse per unit volume with a 70% tungsten concentration became apparent, another strategy for reducing sound levels developed. The greater the impulse performance, the less of the total formulation would be needed for a given total impulse requirement. This would also reduce the total amount of energetics in the motor, and ultimately sound output. More work could certainly be done in optimizing either of these approaches. No work was done with materials other than tungsten. It's possible that other materials might do a better job at damping sound due to their greater volume.

The blowout plugs on the ⅕ scale motor hardware were inserted plain without any adhesive, and worked fine. The throat diameter on those motors was ½", and the uncoated plugs would eject at approximately 3.5 kpsi. The M72 rocket has a throat diameter of 1.25". The tactical units are assembled with a coating of silicone RTV adhesive cured by atmospheric moisture. If the RTV is cured, the blowout plugs will eject at approximately 3.4 kpsi. If the RTV is not used or if it is not fully cured, they will eject at less than 1 kpsi. The 70% tungsten propellant will not reliably ignite at that low pressure, especially at cold temperatures. The standard RTV takes a long time to cure in this configuration. It was found that even six days and with heat treatment, the protected area between the blowout plug and nozzle throat was not cured. Uncured RTV acts more like a lubricant than an adhesive in this state. At the time of testing with the heavy walled M72 static simulator, only one nozzle was available. Multiple shots per day were necessary, so the tactical design/method of using RTV to hold in the igniter blowout plug was not an option.

As an experiment, the igniter plugs were assembled with 5-minute two-part epoxy. This held them in, but too well, and they released at between 4.5-5.5 kpsi. Holding them in too well helped with cold shots, but over-pressurized hot shots. The problem was discovered during testing and caused a significant delay. Eventually a method of simulating the grip of cured RTV was found. The conical lip of the igniter blowout plug was wrapped in self-vulcanizing rubber tape. It would them eject at desirable pressure levels very close to those reported for tactical units. The majority of full-scale static tests were done in this manner. The nozzle inlet was smooth and made of D2 tool steel. As the inlet side of the nozzle became eroded after multiple tests, the plugs started to release at lower and lower pressures. Additional nozzles were fabricated and used. Static full-scale tests were done on high strength aluminum M72 tactical hardware. They have a nozzle formed into the rocket motor case. The first shot, a cold shot, did not ignite the 70% tungsten propellant. Test data from the pressure gage near the nozzle showed that the blowout pressure was low. The ejected plug was inspected and uncured RTV was found on the igniter plug. This outcome was unfortunate because the test was supposed to be an exact replica of tactical units, a precursor to flight tests. The RTV was removed from remaining units and replaced with the self-vulcanizing rubber tape wrap. This set-up did not work as consistently on the aluminum cases, possibly due to RTV residue from removal of the partially cured material.

Some important conclusions can be drawn from all of the above experience. First, if RTV is used as part of the blowout plug design and if it affects release pressure, it is a critical item. Perhaps two part RTV or heat setting RTV should be used, not one that relies on humidity from the atmosphere. The General Electric RTV catalogue specifically recommends that the humidity set RTV should not be used in enclosed designs with limited atmospheric exposure. Unfortunately, in the case of existing tactical hardware, that very design was inherited. The difference between the pressure on the nozzle gage and the head end gage provides a very good indication of when and at what pressure the blowout plug releases at. When the plug is released, the nozzle gage will record a sharp drop in pressure due to the transition from static to dynamic flow. Both locations should be instrumented for pressure data if any work is done on igniters and blowout plugs to minimize confusion. Another important lesson is that the blowout plug release pressure is just as critical as the igniter material and igniter quantity. A design that releases at a slightly lower pressure when hot and a higher pressure when cold could potentially improve ignition and safety. A design that melts out in a cook-off scenario would be ideal. Even when released at the proper pressure after igniting the propellant as desired, the igniter blowout plug can cause pains. The ejected plug is considered a lethal projectile. One final important item concerning the igniter blowout plug is sound. The most important sound emission is the first positive peak, according to MIL-STD-1474D. This value and to a lesser degree the duration of the event is used to calculate dB levels, and graded for allowable exposure levels, number of shots, hearing protection requirements, etc. It was observed in the testing that the ejection of the blowout plug corresponds to the highest sound emission, and the level of the first positive peak. The lower a pressure the blowout plug is ejected at, the lower the sound output of the weapon.

Experimental (Actual) Results from Full Scale Static M72 Simulator

Figure 2:
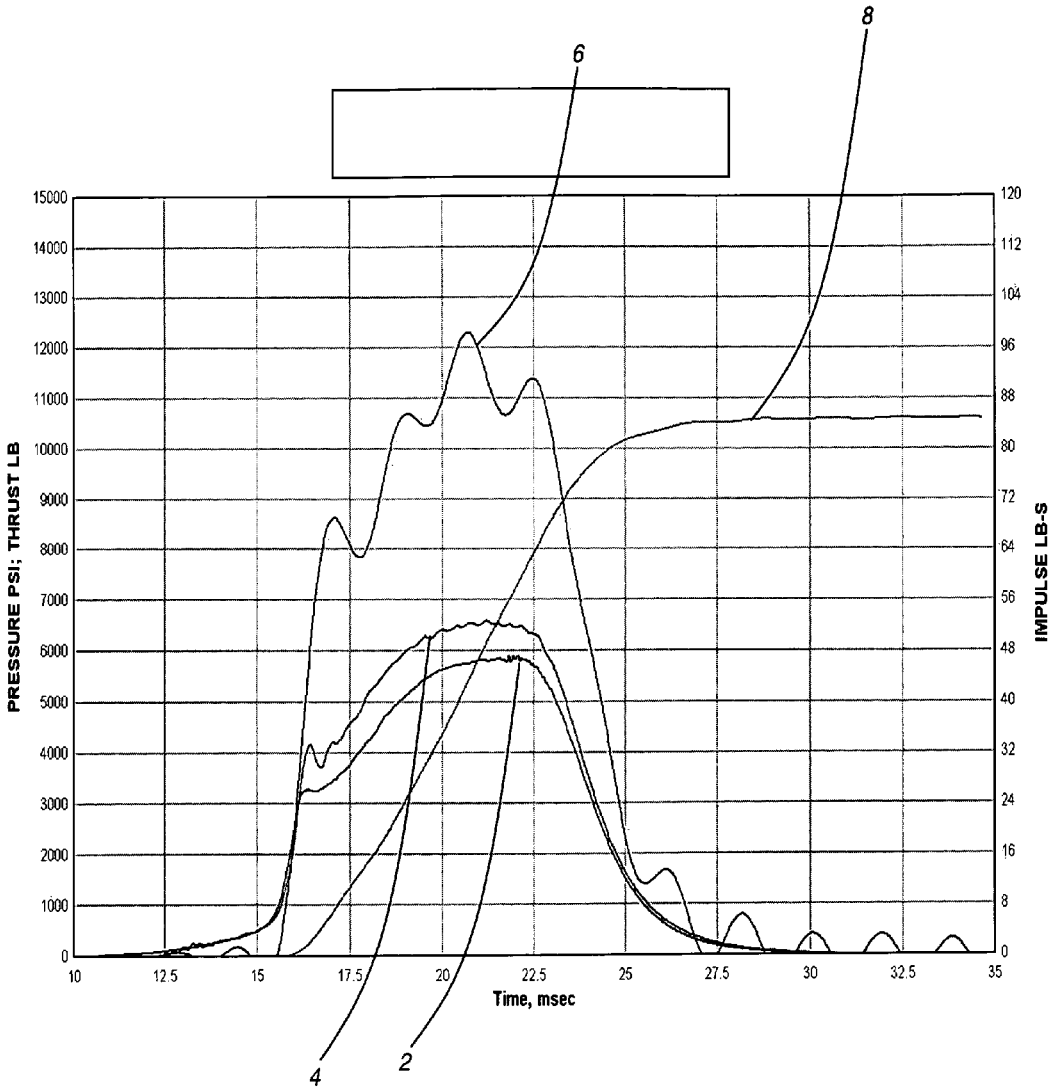
FIG. 2 is a graph illustrating testing results utilizing M7 propellant with a 70% tungsten formulation.
Figure 3:
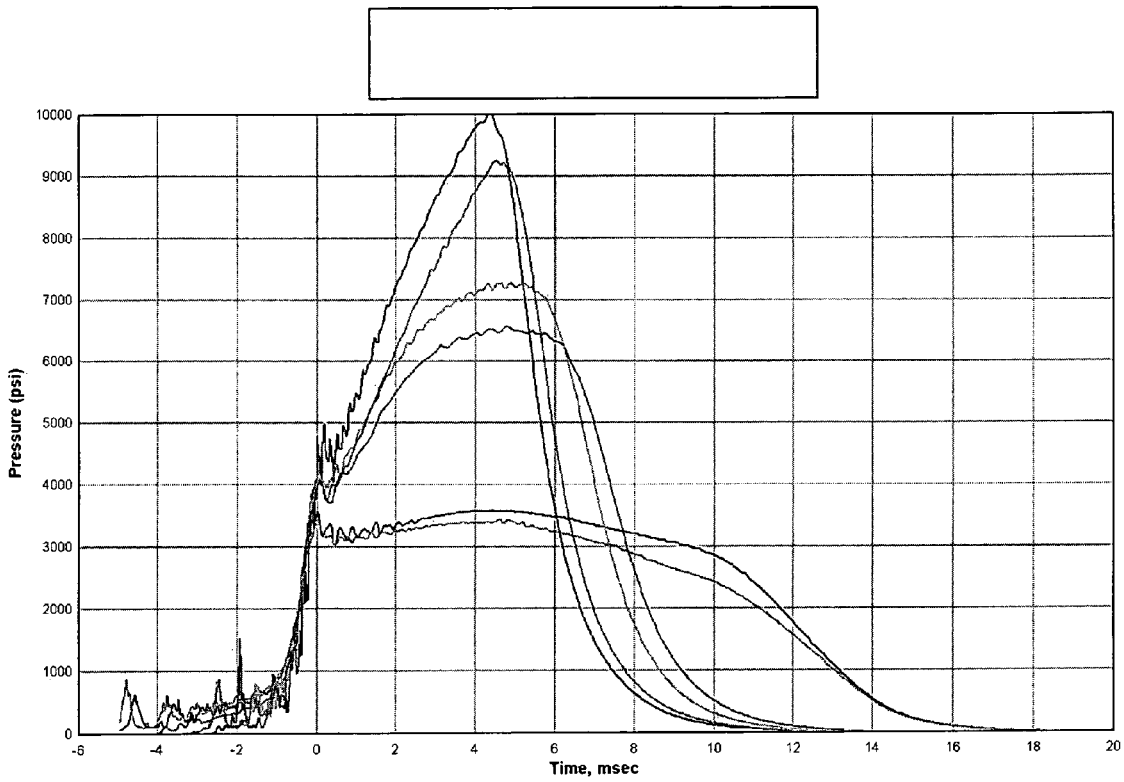
FIG. 3 is a graph illustrating pressure data from six shots at different initial propellant temperatures for the M7/Tungsten formulation.

Referring to FIGS. 1-3, graphs show data from common full-scale static M72 shots. FIG. 1 illustrates results for M7 propellant alone while FIG. 2 illustrates results for an M7 with 70% tungsten formulation. The graphs show pressure traces (represented by lines 2, 4) of two pressure gages, one near the tail end of the propellant sticks (nozzle end) and one near the head end. A line 6 trace represents thrust, and both the pressure and thrust traces are linked to the left axis values. A line 8 trace represents the total impulse, and is linked to the right axis. The line 8 trace shows some ringing related to vibrations in the test stand and test motor, excited by the ejection of the blowout plug. This set of tests is significant because it demonstrates that with the use of M7/Tungsten formulations, increases in total impulse are attainable with no corresponding increase in propellant volume or internal pressure. The graph shown in FIG. 3 contains pressure data from six shots at different initial propellant temperatures for the M7/Tungsten formulations. Two shots each at Ambient, +140° F., and −40° F. are shown. All six shots had an identical quantity of propellant, number of sticks, igniter material and quantity, blowout plug and blowout plug retaining method, etc. This set of tests demonstrates that the propellant can be ignited and that the motor can be made to function properly over the wide range of temperatures required for shoulder launched munitions.

These unusual formulations appear to have the potential to meet the unique requirements of shoulder launched weapons fired from confined spaces and possibly even from enclosures. The basic goal of reducing sound and pressure emissions has been attained. Unique low-pressure burning characteristics may be exploited for improved IM performance. Significant improvements in impulse per unit volume were observed with 70% and 80% tungsten formulations. These improvements were anticipated but not expected. They offer potential options for volume limited systems. They may be used to increase launch velocity, reduce energetic mass, reduce energetic volume, or some combination of the three. Although the work was done with smokeless propellant as the energetic base, similar benefits might be obtained with other chemical propellant bases, as the mechanism providing the improvements is based on a physical reaction rather than chemistry.

Referring to FIGS. 4 through 8, various exemplary embodiments show conceptual use of the high-density rocket propellant of the present invention for recoilless launching. In these Figures, structures subjected to pressure are indicated by conventional section lines and other structures are indicated by solid lines. In the depicted embodiments, regions containing propellant are indicated by dots; regions containing a reaction mass in accordance with the present invention are indicated by cross section lines; and regions containing a combined propellant and reaction mass composition, in accordance with one aspect of the present invention, are indicated by cross section lines filled in with dots.

FIGS. 4 through 8 may be considered as showing recoilless launching with a reaction mass of in a range of about 25% to about 75% of the weight of a projectile, the later including a warhead or other payload and, in FIGS. 5 through 8, a pressure vessel with nozzle and propellant retaining elements which move with the payload. Also, but only for exposition and not by way of limitation, FIGS. 4 through 8 may be considered in connection with launching, as with the above-identified SMAW weapon, of a projectile of about 8.5 lbs. However, the represented launching is carried out, in accordance with one aspect of the present invention, with the above-mentioned reaction mass of about 3.7 lbs and about 0.3 lb of conventional single or double base propellant. The propellant and reaction mass are depicted as separated in FIGS. 4 and 5 and as combined, in accordance with a further aspect, of the invention in FIGS. 6 through 8.

Figure 4:
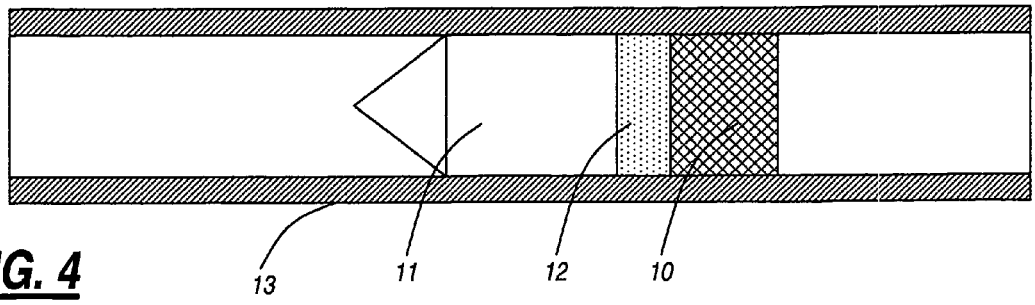
FIG. 4 is a diagram of an embodiment of the present invention using a stationary pressure vessel.

FIG. 4 shows an embodiment of the present invention with the reaction mass 10 having a weight substantially less than the weight of the projectile 11. Reaction mass 10 and projectile 11 have a quantity of propellant 12 disposed between them, and these elements are disposed in a tubular pressure vessel 13 so that pressurized gas from the propellant motivates the reaction mass and projectile oppositely from the pressure vessel with the reaction mass having a higher velocity so that the momentum magnitude of the reaction mass is about equal to the momentum magnitude of the projectile which is launched. As a result, the overall weight of the FIG. 2 embodiment is less than conventional arrangements while the amount of propellant is an amount so that the backblast is less than with a rocket. It may be advantageous to provide an embodiment like that of FIG. 4 with a reaction mass of particulate or other material to reduce danger from this mass rearwardly of the pressure vessel, and this vessel may be provided with any suitable rifling, aiming devices, or mounting.

Figure 5:
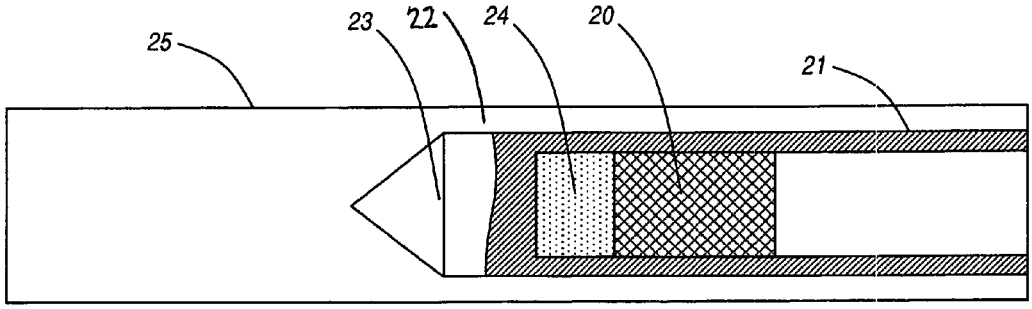
FIG. 5 is a diagram of an embodiment of the invention using a moving pressure vessel.

FIG. 5 shows an embodiment of the present invention where the reaction mass 20 is moveably disposed in a traveling pressure vessel 21 which is a rearward portion of a projectile 22 having a warhead or other payload 23. A quantity of propellant 24 is disposed in the pressure vessel so that pressurized gas from the propellant motivates the projectile and the reaction mass in opposite directions with the reaction mass eventually being expelled from the pressure vessel. As with the embodiment of FIG. 4, the reaction mass has a higher velocity than the projectile so that the momentum magnitude of the reaction mass is about equal to the momentum magnitude of the projectile which is launched with the result that the overall weight of the FIG. 5 embodiment is less than conventional arrangements. Also, and as with the embodiment of FIG. 4, the reaction mass may be of particulate or other material to reduce danger from this mass rearwardly of vessel 21. It can be seen that a device having elements like the previously described elements of FIG. 5 may be fixedly or releasably attached to any object that may be motivated or launched in accordance with the principles of the present invention, so that the object itself serves as a payload. However, elements such as elements 20-24 may be received in any suitable structure such as a launching tube 25 for guiding projectile 22 during launching. Although not involved in the present invention, this tube may be provided with any suitable sighting or mounting devices and may be adapted for storage and transportation of such elements.

Figure 6:
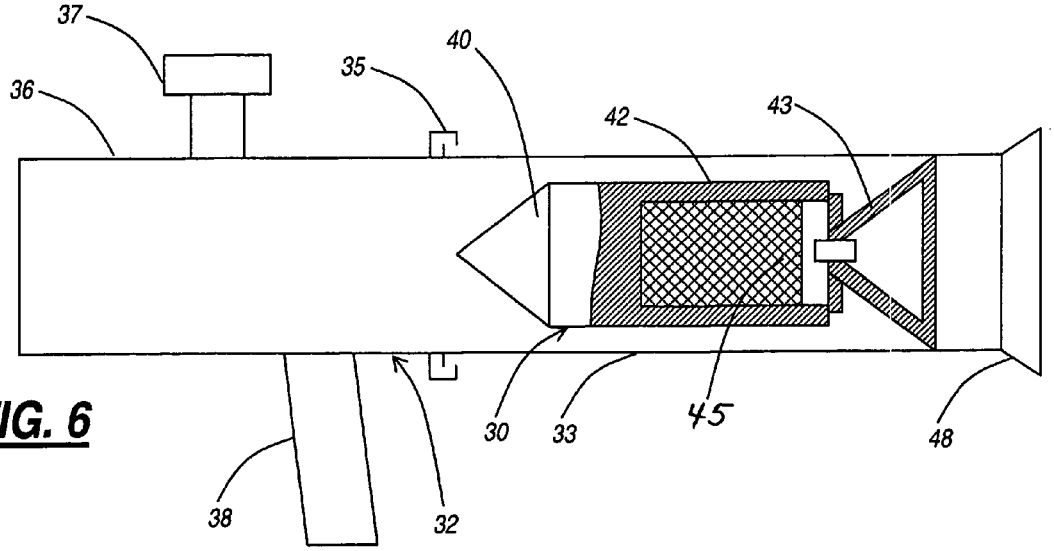
FIG. 6 is a diagram of an embodiment of the invention for shoulder launching.

FIG. 6 shows an embodiment advantageously using for shoulder launching of a projectile 30. However, it is to be understood that this aspect, or either or both of the above-identified first and second aspects in FIGS. 4 and 5, may be used or for other purposes including launching that is not directly or indirectly related to weapons. Referring more specifically to FIG. 6, it is seen that projectile 30 is disposed in a common operating environment including a launching tube 32 formed by an encasement 33, which is adapted for storage and transportation of the projectile and, for launching, is connected by any suitable quick-connector 35 to a forward tube portion 36 which is provided with a sight 37 and a firing device 39 and is thus adapted to guide the projectile during launching. Projectile 30 includes a warhead 40 and a pressure vessel 42 extending rearwardly therefrom and provided with a converging-diverging nozzle 43 for acceleration of pressurized gas and of particulate, inert reaction mass material released from a quantity of a composition 45 disposed in a region of the pressure vessel opposite to the nozzle so that this region is motivated in a direction opposite to the nozzle and so that the inert material is motivated with the pressurized gas through the nozzle and the inert material functions as a reaction mass for recoilless launching of the projectile.

The composition, as described above in detail, combines a propellant and associated such reaction mass material, which is distributed uniformly in the composition, so that progressive reaction of the propellant to generate the pressurized propellant gas releases the particulate material at a rate corresponding to the rate of generation of the pressurized gas. The particulate material is entrained in the propellant gas and accelerated thereby in the nozzle oppositely of the warhead and pressure vessel. The nozzle is configured and the propellant selected so that the magnitude of the momentum of the propellant gas and of the momentum of the reaction mass is about equal to magnitude of the momentum of the momentum of the warhead and the pressure vessel.

In the practice of the present invention with a projectile having a predetermined weight, as with the warhead 40 and pressure vessel 42 in the embodiment of FIG. 6, the weight of the inert, particulate reaction mass material, such as that in composition 45 may, in accordance with the present invention, be provided in the pressure vessel in a weight having a range greater than zero and less than this predetermined weight; and, preferably, may be so provided in a weight having a range of about one-fourth to three-fourths of this predetermined weight.

Any suitable material, including a liquid, may be so provided for the reaction mass material in a composition, typified by composition 45, for practicing the present invention in its broadest embodiments. However, for compactness in an embodiment such as FIG. 6, it is desirable that this material have a density of at least five times the weight of the propellant; and, it is believed that, conventional solid propellants, either single base or double base, may be effective for the purposes of the present invention with the weight of the inert material being at least one-half of the total weight of the composition. The reaction mass material may include tungsten, and metallic tungsten, which has a specific gravity of 19.3, is believed preferable when used in particulate form for an embodiment of the invention like that of FIG. 6. Tungsten does not melt and, so, does not adhere to a nozzle such as nozzle 43 when heated by the propellant gas. Tungsten is difficult to ignite and when so heated does not burn on contact with the atmosphere which would increase backblast pressure and flash. Also, tungsten is generally advantageous since it is not toxic and is relatively inexpensive. As before mentioned, the association of the particles with the propellant may be obtained by dispersing the particles into the propellant when it is in liquid form before solidifying. When particulate tungsten metal is so dispersed, it is believed that the proportion by weight of particulate tungsten material in a composition of propellant and reaction mass may, for the purposes of the present invention, be in a range of about 50% to about 90% so that the high proportion of inert material provides an insensitive munition.

In an embodiment of the present invention like that of FIG. 6, to help disperse the reaction mass particles upon exit from a nozzle corresponding to nozzle 43, the nozzle may be configured for under-expansion of propellant gas exiting the nozzle. That is, the gas is not expanded completely to atmospheric pressure in the nozzle so that the residual pressure further expands the gas beyond the nozzle spreading the particles as the gas expands. Relatedly, when a desired sufficient expansion of the propellant gas cannot be obtained because the nozzle exit diameter is limited by the diameter of a projectile, such as projectile 30, the rearward end of the corresponding launching tube 32 may be provided with a diverging nozzle 48 for further expansion of the gas.

Figure 7:
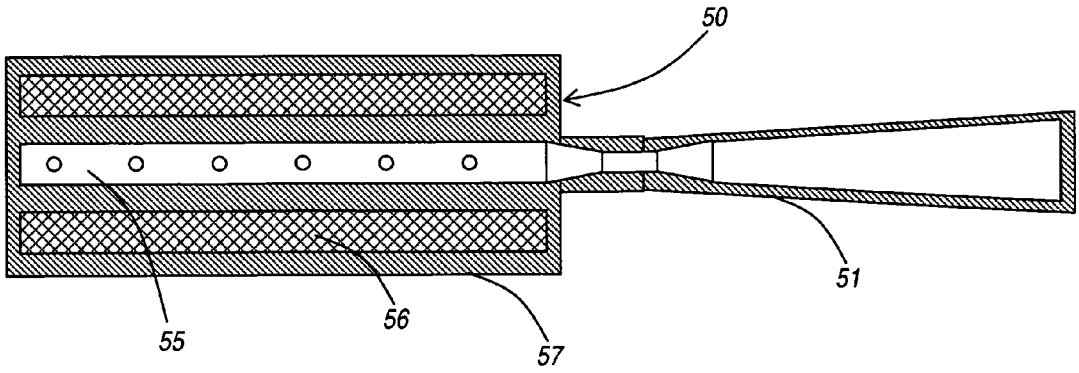
FIG. 7 is a diagram of an embodiment of the invention, approximately to scale, using a high-low chamber and an extended nozzle.

FIG. 7 illustrates a structure having two features that may, independently, be advantageous with the present invention, the structure having a high-low combustion or reaction chamber 50 associated with an extended nozzle 51. Chamber 50 includes a tubular, perforated barrier 55 having a recoilless launching composition 56 of the present invention disposed on the outer side of the barrier before generation of propellant gas and release of particulate reaction mass material. The composition is enclosed in a cylindrical pressure vessel 57 which opens at one end to nozzle 51 from tubular barrier 55 so the propellant gas and the reaction mass particles must flow through the barrier perforations to the nozzle. As a result, and to facilitate the propellant reaction, the propellant reaction pressure may be much higher than the nozzle entrance pressure. A common converging-diverging nozzle for acceleration of pressurized gas has proportions about like those of nozzle 43 in FIG. 6; and, as before mentioned, similar proportions may be satisfactory for the purposes of the present invention to accelerate particulate tungsten reaction mass material with propellant gas when the particles are of relatively small diameter. However, with relatively larger diameter particles, an extended converging-diverging nozzle, corresponding to nozzle 51 and having a greater length than the length required to accelerate the propellant gas alone, may be effective to accelerate the particles to a velocity providing a desired momentum of the reaction mass.

Figure 8:
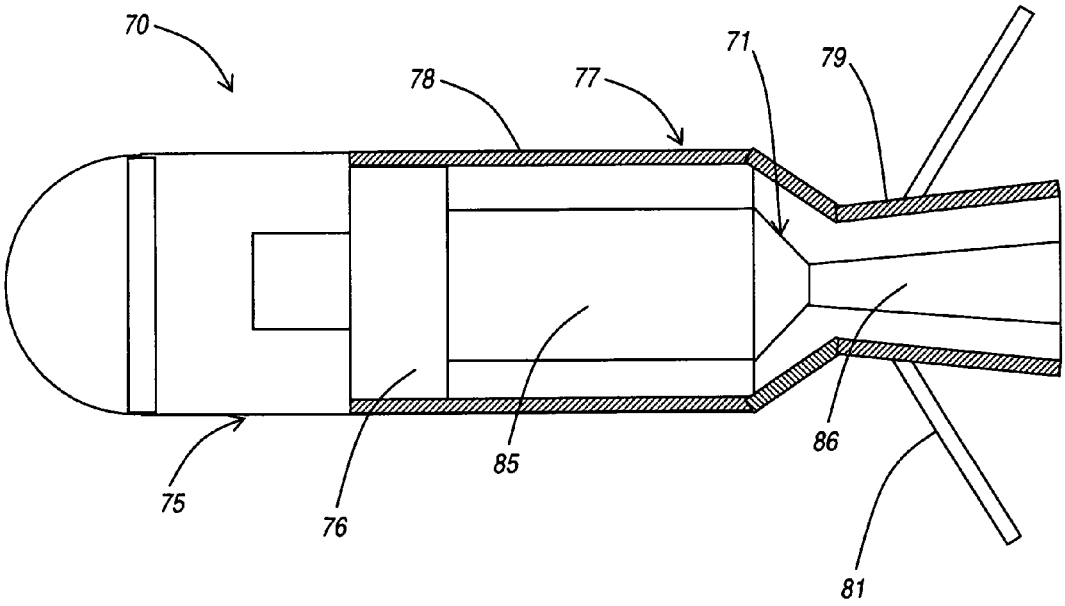
FIG. 8 is a diagram, approximately to scale, of an embodiment of the invention in a conventional rocket projectile case.

FIG. 8 shows a conventional rocket projectile case, indicated generally by numeral 70, in which a motor 71, which embodies the third aspect of the present invention, and resembles the structure shown in FIG. 7, has replaced a rocket motor for which the case was originally intended. Case 70 has a forward warhead portion 75, which includes a fuse section 76, and has a rearward motor portion 77 including a propellant region 78 and a nozzle 79. At the motor portion, the case is sufficiently thick to withstand propellant gas pressure from the original about 1.0 lb of propellant which filled region 78 for generation of gaseous reaction mass. Fins 81 are depicted as mounted on the nozzle and, like the warhead portion, function with the present invention as with the original motor. Motor 71 has a region 85, which is for a solid propellant and inert particulate tungsten reaction mass composition of the present invention, and has an extended nozzle 86 for accelerating generated propellant gas and released particulates.

With a composition in region 85 like that described above in using about 0.3 lb of propellant having a specific gravity of about 1.0 with a dispersed inert reaction mass of 3.7 lb of tungsten particles having a specific gravity of about 19.3, the weight of the inert material is much more than one-half the weight of the composition. Further, the relative volume of the composition is about 0.3 for the propellant plus about 3.7 divided by 19.3, which is about 0.19, for the inert material for a total relative composition volume of about 0.49. On the same basis, the relative volume of the original 1.0 lb of propellant would be 1.0, so that region 85 can be substantially smaller diametrically than region 78. Also, nozzle 86 can fit, longitudinally, in nozzle 79. As a result, recoilless launching in accordance with the present invention with its advantages of greatly reduced backblast hazard, noise, and flash, can be substituted in a existing projectile and launcher with no loss in military effectiveness.

Although the present invention has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present invention and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A rocket propellant, comprising:

propellant material; and an inert and solid counter-mass material comprising tungsten powder mixed with the propellant material at a time of manufacture.

2. The rocket propellant of claim 1, wherein the propellant material mixed with the tungsten powder is pressed out in a geometry such that the tungsten powder is thoroughly and uniformly dispersed with the propellant material.

3. The rocket propellant of claim 1, wherein the propellant material comprises nitrocellulose, nitroglycerin, potassium perchlorate, ethyl centralite, and carbon black.

4. The rocket propellant of claim 1, wherein the tungsten powder comprises a size range of about 5-about 150 microns in diameter.

5. The rocket propellant of claim 1, wherein the tungsten powder comprises a size range of about 5-about 44 microns in diameter.

6. The rocket propellant of claim 4, wherein the mass percentage of the tungsten powder and the tungsten particle size range are selected to optimize total impulse, sound reduction, and Insensitive Munitions performance.

7. The rocket propellant of claim 1, wherein the rocket propellant is utilized in one of a Shoulder-launched Multipurpose Assault Weapon (SMAW) system and a Light Anti-Tank Weapon (M72 LAW) system.

8. The rocket propellant of claim 1, wherein the rocket propellant is formed with a grain geometry comprising one of thick walled long burning solid and hollow cylinders.

9. A system for recoilless launching, comprising:

a portion for launching, wherein the portion comprises a predetermined weight;

a non-gaseous reaction mass portion comprising a weight in a range of about one-fourth to three-fourths of said predetermined weight;

a pressure vessel moveably receiving the reaction mass; and a pressurized propellant gas generation mechanism in the pressure vessel so that the portion to be launched and said non-gaseous reaction mass portion are motivated in opposite directions by the gas, wherein the non-gaseous reaction mass portion is an inert and solid counter-mass material comprising tungsten powder.

10. The system of claim 9, wherein the tungsten powder comprises a mass percentage relative to a propellant material of about 70%-80%, equivalent to 17%-26% by volume of the propellant material.

11. A method for formulating a high-density rocket propellant, comprising:

determining a balance between a carry weight of a device and back blast of the device when fired;

determining a mass percentage, of an inert and solid counter-mass material comprising tungsten relative to a propellant material and a particle size of the tungsten, wherein the mass percentage and the particle size are responsive to the balance; and mixing an amount of tungsten based on the mass percentage and the particle size with the propellant material thereby thoroughly and uniformly dispersing the tungsten within the propellant material.

12. The method of claim 11, further comprising:

utilizing the tungsten and the propellant material, which were mixed, in the device thereby providing a low-blast propulsion system.

13. The method of claim 11, wherein the mass percentage comprises a range of about 70%-about 80%, equivalent to about 17%-about 26% by volume of the propellant material.

14. The method of claim 11, wherein the propellant material comprises nitrocellulose, nitroglycerin, potassium perchlorate, ethyl centralite, and carbon black.

15. The method of claim 11, wherein the particle size comprises a range of about 5-about 150 microns in diameter.

16. The rocket propellant of claim 1, wherein the tungsten powder comprises a mass percentage relative to the propellant material of about 70%-about 80%, equivalent to about 17%-about 26% by volume of the propellant material.

17. The rocket propellant of claim 1, wherein the propellant material comprises at least nitroglycerin dissolved as a plasticizer in nitrocellulose.

* * * * *